United States Patent [19]

Hohmann

[11] 4,078,668

[45] Mar. 14, 1978

[54] APPARATUS FOR MONITORING AND RECORDING THE LOAD OF A CRANE WITH A PIVOTAL BOOM

[75] Inventor: Walter Hohmann, Essen-Werden, Germany

[73] Assignee: Kruger & Co. KG, Essen-Werden, Germany

[21] Appl. No.: 651,690

[22] Filed: Jan. 23, 1976

[30] Foreign Application Priority Data

Feb. 4, 1976 Germany ..... 2504445

[51] Int. Cl.[2] ..... B66C 13/48

[52] U.S. Cl. ..... 212/39 MS; 340/267 C

[58] Field of Search ..... 212/39 R, 39 A, 39 DB, 212/39 MS; 340/267 C; 235/151.3

[56] References Cited

U.S. PATENT DOCUMENTS

| | | | |
|---|---|---|---|
| 3,489,294 | 1/1970 | Greb et al. | 212/39 R |
| 3,638,211 | 1/1972 | Sanchez | 212/39 MS |
| 3,641,551 | 2/1972 | Sterner et al. | 340/267 C |
| 3,740,534 | 6/1973 | Kezer et al. | 340/267 C X |
| 3,819,922 | 6/1974 | Horn et al. | 235/151.33 |

FOREIGN PATENT DOCUMENTS

| | | | |
|---|---|---|---|
| 1,935,791 | 5/1971 | Germany | 212/39 MS |
| 1,360,128 | 7/1974 | United Kingdom | 212/39 MS |

*Primary Examiner*—Drayton E. Hoffman
*Assistant Examiner*—R. B. Johnson
*Attorney, Agent, or Firm*—Karl F. Ross

[57] ABSTRACT

A crane boom pivotal about a horizontal axis is monitored as to loading over a prolonged period, e.g. a period of about 24 hours, by providing a position-dependent output representing the maximum permissible load moment on the boom at a particular position thereof relative to its support and a load sensor responsive to the instantaneous loading (load moment) of the boom. These two sensors provide inputs to a quotient-forming comparator whose output is applied to a 24-hour disk or tape recorder. The output of the quotient-forming comparator also controls a device for immobilizing the drive system for the boom, preventing it from exceeding its maximum permissible load.

4 Claims, 1 Drawing Figure

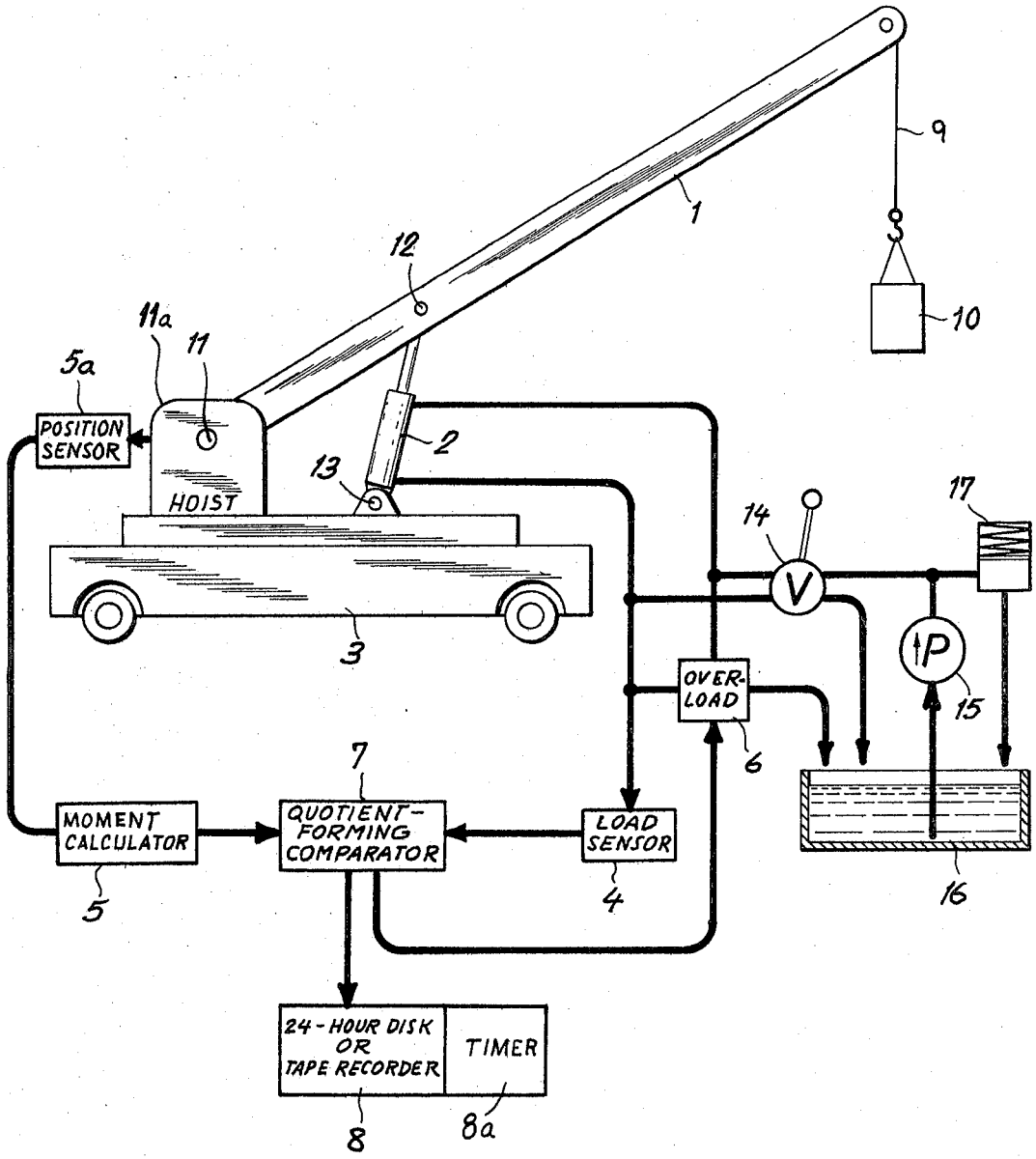
1
2
3
4
5
5a
6
7
8
8a
9
10
11
11a
12
13
14
15
16
17
POSITION SENSOR
HOIST
OVER-LOAD
MOMENT CALCULATOR
QUOTIENT-FORMING COMPARATOR
LOAD SENSOR
24-HOUR DISK OR TAPE RECORDER
TIMER
V
P

APPARATUS FOR MONITORING AND RECORDING THE LOAD OF A CRANE WITH A PIVOTAL BOOM

FIELD OF THE INVENTION

The present invention relates to an apparatus for monitoring the load moment or, more generally, the loading of an adjustable boom of a crane provided with a boom-displacement means. More particularly the invention relates to the monitoring of the loading of a crane boom over prolonged periods.

BACKGROUND OF THE INVENTION

In conventional crane-monitoring arrangements it is a common practice to provide a device for monitoring the loading of the boom of a crane having a key-actuated switch or the like which automatically operates upon an overloading of the boom, i.e. the application of a loading moment to the boom in excess of the maximum permissible loading, thereby immobilizing the crane-boom drive. Thereafter the system can be released by operating the key-actuated switch.

Such systems, of course, create difficulties in practice because interruption of the operation of the crane to the point that personnel having control over the key-operated switch must be present to render the crane usable again creates a severe difficulty.

Furthermore, when the crane exceeds the maximum permissible load only for short periods which are not of significant concern, the automatic operation of the immobilizing device is highly objectionable.

Finally, it is important, especially with rented cranes and the like, to appreciate the degree to which the crane has been used at previous operations so as to enable maintenance and supervision practices to correspond to the usage of the crane.

Conventional systems for this purpose have proved to be unsatisfactory.

OBJECTS OF THE INVENTION

It is an object of the present invention to provide a device for the monitoring of the loading (the load moment) of a crane boom which avoids the aforementioned disadvantages and provides an effective and continuous supervision of the crane and its operation.

Another object of the invention is to provide an improved apparatus for controlling the loading of a swingable crane boom.

SUMMARY OF THE INVENTION

These objects and others which will become apparent hereinafter are attained, in accordance with the present invention, for a crane having a swingable boom and a drive means for displacing this boom within a normal operating range.

Generally the boom is pivotal about a horizontal axis between, for example, a substantially horizontal lower position and an elevated position. A given load, for example, will apply a reduced loading moment to the boom (if the load is suspended vertically and acts solely under gravity) when the boom is in a relatively elevated position, but a substantially higher load moment when the boom is in a less elevated or more horizontal position.

Consequently, when reference is made herein to the load upon the boom, it should be understood that the reference is intended to the loading moment, i.e. the mass applied to the boom multiplied by the horizontal component of the force applied to the boom.

Every boom has, for each angular position about its horizontal or pivotal axis, *a* maximum permissible load moment. This corresponds, with a safety factor, to the maximum load which can be applied to the boom assuming the corresponding horizontal component of the applied force.

According to the invention, a sensor is provided for the actual load applied to the boom and an input device is provided to generate a signal representing the maximum permissible load moment depending upon the position of the boom; the signal from the latter device and the measured or sensed load signal are applied to a quotient-forming comparator which produces an input representing the quotient of these two input signals. An output signal representing the quotient is applied, according to the invention, to a recorder triggered by a synchronous clockwork mechanism, which registers the value of the quotient signal as a function of time for prolonged periods.

Preferably, all the signals mentioned above are electrical signals. For example, the input device provides an electrical input signal proportional to the maximum permissible loading moment of the boom at the instantaneous position thereof, the measuring device provides an electrical signal which is a function of the instantaneous loading moment actually acting upon the boom, and the quotient-forming comparator provides an electrical signal representing the quotient of the first two electrical signals. The output signal of the quotient-forming comparator is then registered as a function of time on an electrically responsive recording device, preferably a circular-disk or tape recorder in which the recording medium is driven over a prolonged period, preferably a period of 24 hours or more.

The advantages attained with the system according to the present invention can be found in the fact that the device can monitor the load moment of a variable-position crane boom by the recorder over prolonged periods in a simple manner, allowing subsequent review of the operating characteristics of the boom, while the monitoring device itself is capable of providing an indication of failure of any part thereof. For example, should be sensor responsive to the instantaneous load moment, the input providing an indication of the maximum permissible loau moment for any position of the boom, the quotient-forming comparator or any other element of the circuit fail, the recording device will show a jump toward its zero or maximum positions, thereby indicating failure of the relevant unit.

Furthermore, the quotient-forming comparator can be provided with an output which automatically acts upon the crane-boom drive to immobilize the latter when the maximum load moment for the boom is achieved in practice. This device need not be key-operated and, upon reduction of the loading, the device may automatically respond to allow further movement of the crane boom. Since a record is provided of the load operations of the crane, the device is highly suitable for review of the operation of a rentable crane.

The mode of operation of the system according to my invention, therefore, thus involves providing an instantaneous signal representing the maxmum load moment for each position of a pivotable crane boom, measuring the actual (instantaneous) load moment on the boom, forming a quotient from the two signals and providing a quotient or comparator signal representing this quotient, and recording the latter signal as a function of time over a prolonged period, e.g. a period of 24 hours. The procedure also comprises immobilizing the movement of the crane boom upon the comparator or quotient signal representing the matching of the measured load moment with the predetermined maximum permissible load moment of the boom.

The apparatus embodying my invention can be constructed in various ways. For example, the quotient-forming device can itself be a comparator which, in turn, operates through a threshold device to control the crane boom drive. The recorder can either be a circular-disk recorder or a magnetic-tape recorder or any other recording device capable of registering the quotient-comparator signal over a prolonged period. It is desirable that the recorder be of the endless type, i.e. the recording medium can be an endless band or disk making a full revolution within a 24-hour period. The recorder may provide an alert signal enabling the band or disk to be changed at the end of the 24-hour period and resetting the system for a new recording session.

BRIEF DESCRIPTION OF THE DRAWING

The above and other objects, features and advantages of the present invention will become more readily apparent from the following description, the sole FIGURE of which is a diagrammatic elevational view of a crane provided with the monitoring system of the present invention.

SPECIFIC DESCRIPTION

The sole FIGURE of the drawing illustrates a device for monitoring the load moment of a pivotal-boom crane in which a swinging boom 1 is pivoted at 11 to a mounting 11*a* on a chassis 3 forming a mobile crane. The boom drive is represented by the double-acting piston-cylinder arrangement 2 which is hydraulically operated. To this end a distributor value 14 is provided and is capable of manual control. A hydraulic pump 15 supplies fluid to the value and fluid is returned therefrom to the reservoir 16 from which the pump draws. A pressure-relief valve 17 shunts the output of the pump to the resevoir in case of excessive pressure buildup at the pump. The piston-cylinder arrangement 2 is articulated at 12 to the boom and at 13 to the crane chassis. The double-acting hydraulic cylinder swings the boom in a vertical plane. The boom is provided with a cable 9 which may be wound upon a conventional windlass or hoist and is capable of hoisting a load represented schematically at 10.

The device for monitoring the load moment comprises basically a load sensor 4 capable of producing an electrical signal representing the instantaneous actual load moment on the crane boom. This device may be any pressure-electrical transducer responsive to the pressure within the cylinder 2. For example, the device can comprise a pressure detector whose membrane is applied to a strain gauge producing a continuous electrical output representing the pressure and hence the load moment (see chapter 2, page 20 of Perry's *Chemical Engineers' Handbook,* McGraw-Hill Book Co., N.Y., 1963).

An input device comprises a position-load indicator, for example, a position sensor 5*a* connected to a moment calculator 5 whose electrical output is a function of the maximum permissible load for each position of the boom. The position sensor 5*a* may be any analog position-measuring device, e.g. a potentiometer or syncro connected to the boom whose voltage drop represents the boom position and is applied to the calculator 5 having a sinusoidal multiplication function forming a product and producing the aforementioned output which is a function of the maximum permissible load moment for any position represented by the output of the unit 5*a*. Devices of this type can be found in *Servomechanism Practice,* Ahrendt and Savant, McGraw-Hill Book Company, N.Y., 1960.

The electrical signals from units 4 and 5 are applied to a quotient-forming comparator 7 which produces an electrical output representing the quotient of the two signals (chapter 15, pages 74–76 of *Handbook of Telemetry and Remote Control,* McGraw-Hill Book Company, N.Y., 1967). Upon equality of the instantaneous load moment and the maximum permissible load moment for the boom 2, the comparator 7 triggers a stop unit 6 which may be a valve bridging the two sides of the cylinder 2 and thereby immobilizing the boom 1 until the load 10 is lowered and the load moment is thereby reduced.

As noted, the unit 4 can respond to the load moment as a function of the pressure in the boom-support cylinder 2 using an electromechanical measuring device and transducer. The unit 5*a* for producing a signal representing the maximum permissible load moment for each angular position of the boom can, as indicated, sense the actual instantaneous boom position and provide an input to the unit 5 which generates the electrical signal representing the maximum permissible load moment corresponding to the instantaneous position.

The quotient-forming comparator 7 forms the analog ratio of the instantaneous load moment and the highest permissible load moment which is recorded on a recorder 8 driven by a synchronous clockwork or timer 8*a* and registers the output of the comparator as a function of time. In the illustrated embodiment and according to a preferred configuration of the invention, the comparator 7 itself is the quotient-forming device. However, it is also possible to provide a quotient-forming (divider) device separate from the comparator 7.

The recorder 8, although not shown in detail, can be a circular disk recorder (e.g. the circular chart recorder shown at chapter 22, page 24 of Perry's, op cit.) or a magnetic-band recorder and preferably has and endless recording medium making a full revolution over a 24-hour period and registering the output of the comparator continuously over this period. When the recorder operates digitally, it can provide an output to the comparator which extinguishes the previous signal before the subsequent signal is recorded.

I claim:

1. In a crane with a chassis, a boom, mounting means pivotally securing said boom on said chassis for movement in a vertical plane about a horizontal axis, actuating means for swinging said boom about said axis, and hoist means on said boom for raising and lowering a load, the improvement comprising a monitoring device for recording the load on the crane for a finite period, said device including:

first sensing means operatively connected to said actuating means for determining the instantaneous load moment thereof and producing a first electrical signal representing said instantaneous load moment;

second sensing means operatively connected to said mounting means and responsive to the position of said boom for producing a second electrical signal representing the instantaneous maximum permissible load moment thereof;

a quotient-forming comparator connected to said first and second sensing means and responsive to said first and second signals for producing an electrical output signal representing the ratio of the instantaneous load moment and the maximum permissible load moment of said boom;

stop means connected to said actuating means and responsive to said output signal for immobilizing said actuating means upon said instantaneous load moment equaling said maximum permissible load moment; and a recorder connected to said quotient-forming comparator means and including timing means for registering said output signal as a function of time over said finite period.

2. The device defined in claim 1 wherein said recorder is a circular-disk recorder.

3. The device defined in claim 1 wherein said recorder is a magnetic band recorder.

4. The device defined in claim 1 wherein said recorder has an endless signal-recording medium upon which said signal is recorded.

* * * * *